US007639227B2

(12) United States Patent
Chuang et al.

(10) Patent No.: US 7,639,227 B2
(45) Date of Patent: Dec. 29, 2009

(54) INTEGRATED CIRCUIT CAPABLE OF SYNCHRONIZING MULTIPLE OUTPUTS OF BUFFERS

(75) Inventors: Kai-Lan Chuang, Tainan County (TW); Chuan-Che Lee, Tainan County (TW); Wen-Teng Fan, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 634 days.

(21) Appl. No.: 11/380,009

(22) Filed: Apr. 25, 2006

(65) Prior Publication Data

US 2007/0247411 A1 Oct. 25, 2007

(51) Int. Cl.
*G09G 3/36* (2006.01)

(52) U.S. Cl. ..... 345/100; 326/112

(58) Field of Classification Search ..... 345/92, 345/100, 204

See application file for complete search history.

(56) References Cited

U.S. PATENT DOCUMENTS 6,046,719 A * 4/2000 Dingwall ..... 345/100
6,067,066 A * 5/2000 Kubota et al. ..... 345/98
6,154,192 A * 11/2000 Katakura et al. ..... 345/98
2002/0018039 A1* 2/2002 Morita ..... 345/100
2002/0140461 A1* 10/2002 Enam et al. ..... 327/65
2003/0063053 A1* 4/2003 Yamazaki et al. ..... 345/82
2004/0150611 A1* 8/2004 Tanaka ..... 345/100
2005/0057481 A1* 3/2005 Chung ..... 345/100
2005/0275459 A1* 12/2005 Nishimura ..... 330/257

* cited by examiner

*Primary Examiner*—Alexander Eisen
*Assistant Examiner*—Matthew Yeung
(74) *Attorney, Agent, or Firm*—Winston Hsu

(57) ABSTRACT

A source driver of an LCD includes a first and second power sources, a first and second inversion units, a first and second charging switches, and a first and second discharging switches. The first charging switch is coupled to the first power source, a first end of the first inversion unit, and a second end of the second inversion unit. The second charging switch is coupled to the first power source, a first end of the second inversion unit, and a second end of the first inversion unit. The first discharging switch is coupled to the second power source, the second end of the first inversion unit, and the first end of the second inversion unit. The second discharging switch is coupled to the second power source, the second end of the second inversion unit, and the first end of the first inversion unit.

10 Claims, 7 Drawing Sheets

INTEGRATED CIRCUIT CAPABLE OF SYNCHRONIZING MULTIPLE OUTPUTS OF BUFFERS

BACKGROUND OF THE INVENTION

1. Field of the Invention

The present invention relates to an integrated circuit capable of synchronizing multiple outputs, and more particularly, to a source driver of a display device capable of synchronizing multiple outputs.

2. Description of the Prior Art

Liquid crystal display (LCD) devices are used in various devices such as personal computers or television screens due to their advantages of thinness, light weight, and low power consumption. Color liquid crystal display devices with an active matrix system in particular, which are advantageous for controlling image quality with high definition, have become dominant.

FIG. 1 shows a diagram of a prior art liquid crystal display device 10 including an LCD panel 12, a controller 14, a plurality of gate drivers 16, and a plurality of source drivers 20-2*n*. Though the details of the LCD panel 12 are not illustrated, the LCD panel 12 is constituted from a structure including a semiconductor substrate with transparent pixel electrodes and thin film transistors (TFTs) disposed thereon, an opposing substrate with one transparent electrode formed on an entire surface thereof, and a liquid crystal sealed between these two opposing substrates. Then, by controlling the TFTs, a predetermined voltage is applied to each pixel electrode, and the transmissivity or reflectivity of the liquid crystal is changed by a potential difference between each pixel electrode and the electrode on the opposing substrate. A scanning signal in a pulse form is sequentially transmitted to a scan line on the LCD panel 12 from a corresponding gate driver 16. TFTs connected to the gate line to which a pulse is applied are all turned on. At this point, gray-scale voltages are supplied to the data lines of the LCD panel 12 from the respective source drivers 20-2*n* and applied to pixel electrodes through the turned-on TFTs. Then, when the TFTs connected to the gate line to which no pulse is applied any longer are turned off, potential differences between the pixel electrodes and the opposing substrate electrode are held for a period until subsequent gray-scale voltages are applied to the pixel electrodes. Then, by sequential pulse application, predetermined gray-scale voltages are applied to all pixel electrodes. By performing gray-scale voltage rewriting in each frame period, an image can be displayed.

FIG. 2 shows a diagram of the source driver 20 of the liquid crystal display device 10 constituting an interface circuit for chip-to-chip data transfer. Since the source drivers 21-2*n* have the same structure as the source driver 20 shown in FIG. 2, corresponding illustrations and descriptions will be omitted. The source driver 20 includes an RSDS (reduced swing differential signaling) receiver 30, a shift register 40, a data capturing circuit 50, a latch 60, a level shifter 70, a digital-to-analog conversion circuit (which will be hereinafter referred to as a D/A converter) 80, and an output buffer 90. Based on the input signal INV1, the RSDS receiver 30 generates the output signal OUT1 and a data signals DATA to the shift register 40 and the data capturing circuit 50, respectively. The latch 60 holds the data signals captured by the data capturing circuit 50 at the timing of the front edges of the latch signals STB, and then collectively supplies the latched data signals to the level shifter 70 during each horizontal period. The level shifter 70 increases the voltage levels of the data signals DATA from the latch 60, and then outputs the data signals to the D/A converter 80. The D/A converter 80 supplies gray scale voltages corresponding to the logic values of the data signals to the output buffer 90, which then outputs the gray-scale voltages at the timing of the rear edges of the latch signals STB. For the liquid crystal display device 10 to function efficiently, the output signals supplied by the RSDS receivers (referred to as 30-3*n* in FIG. 3) of the source drivers 21-2*n* have to be synchronized.

Since the input signals are generated by the controller 14, different input signals encounter different resistance according the distances between the controller 14 and corresponding RSDS receivers. FIG. 3 is a diagram showing an equivalent circuit of the RSDS receiver 30-3*n* of the source drivers 20-2*n*. In FIG. 3, VDD and VSS are power sources supplying power to the RSDS receivers 30-3*n* via a power line PL and a ground line GL, respectively. I1-I*n* are analog current sources. RD1-RDn are parasitic resistors of the power line PL, and RS1-RSn are parasitic resistors of the ground line GL. VD1-VDn and VS1-VSn represent the bias voltages of the RSDS receivers 30-3*n*, respectively. Usually the RSDS receivers 30-3*n* are disposed in a way such that the parasitic resistors RD1-RDn and RS1-RSn have the same resistance. The voltage difference established across each parasitic resistor when the liquid crystal display device 10 is operating is represented by Δ. The bias voltages VD1-VDn can be respectively represented by VDD-Δ, VDD-2*Δ, . . . , VDD-n*Δ, and the bias voltages VS1-VSn can be respectively represented by VSS+Δ, VSS+2*Δ, . . . , VSS+n*Δ. Since each RSDS receiver has different bias voltages, the output signals OUT1-OUTn cannot be outputted simultaneously. Therefore, the performance of the prior art liquid crystal display device 10 cannot be optimized.

SUMMARY OF THE INVENTION

The present invention provides an integrated circuit capable of synchronizing multiple outputs comprising a first power source, a second power source, a first and second units for providing a plurality of output voltages at corresponding output ends, a first charging switch, a second charging switch, a first discharging switch, and a second discharging switch. The first charging switch includes a first end coupled to the first power source, a second end coupled to a first end of the first inversion unit, and a control end coupled to a second end of the second inversion unit. The second charging switch includes a first end coupled to the first power source, a second end coupled to a first end of the second inversion unit, and a control end coupled to a second end of the first inversion unit. The first discharging switch includes a first end coupled to the second power source, a second end coupled to the second end of the first inversion unit, and a control end coupled to the first end of the second inversion unit. The second discharging switch includes a first end coupled to the second power source, a second end coupled to the second end of the second inversion unit, and a control end coupled to the first end of the first inversion unit.

The present invention also provides a circuit for synchronizing outputs of a first and a second output buffers, each of which has a first and second end for receiving bias voltages, the circuit comprising a first switch having a first end coupled to receive a first voltage, a second end coupled to the first end of the first output buffer, and a control end coupled to the second end of the second output buffer; a second switch having a first end coupled to receive the first voltage, a second end coupled to the first end of the second output buffer, and a control end coupled to the second end of the first output buffer; a third switch having a first end coupled to receive a second voltage, a second end coupled to the second end of the first output buffer, and a control end coupled to the first end of the second output buffer; and a fourth switch having a first end coupled to receive the second voltage, a second end coupled to the second end of the second output buffer, and a control end coupled to the first end of the first output buffer.

The present invention also provides a circuit for synchronizing outputs of a first, second and third output buffers, each of which has a first and second end for receiving bias voltages, the circuit comprising a first switch having a first end coupled to receive a first voltage, a second end coupled to the first end of the first output buffer, and a control end coupled to the second end of the second output buffer; a second switch having a first end coupled to receive the first voltage, a second end coupled to the first end of the second output buffer, and a control end coupled to the second end of the first output buffer; a third switch having a first end coupled to receive a second voltage, a second end coupled to the second end of the first output buffer, and a control end coupled to the first end of the second output buffer; a fourth switch having a first end coupled to receive the second voltage, a second end coupled to the second end of the second output buffer, and a control end coupled to the first end of the first output buffer; a fifth switch having a first end coupled to receive the first voltage, a second end coupled to the first end of the third output buffer, and a control end coupled to the second end of the third output buffer; and a sixth switch having a first end coupled to receive the second voltage, a second end coupled to the second end of the third output buffer, and a control end coupled to the first end of the third output buffer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
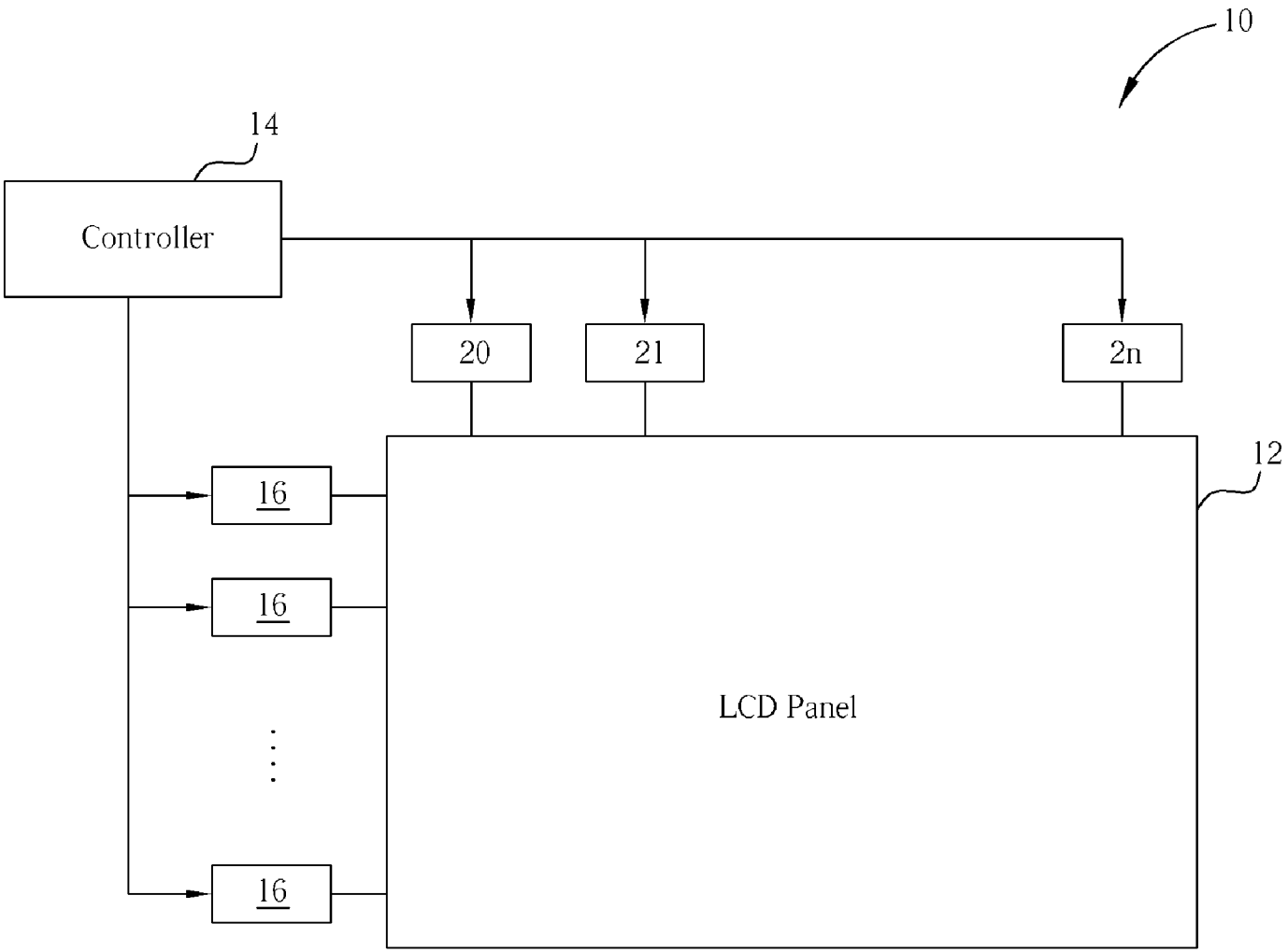
Fig. 1 Prior Art
FIG. 1 shows a diagram of a prior art liquid crystal display device.
Figure 2:
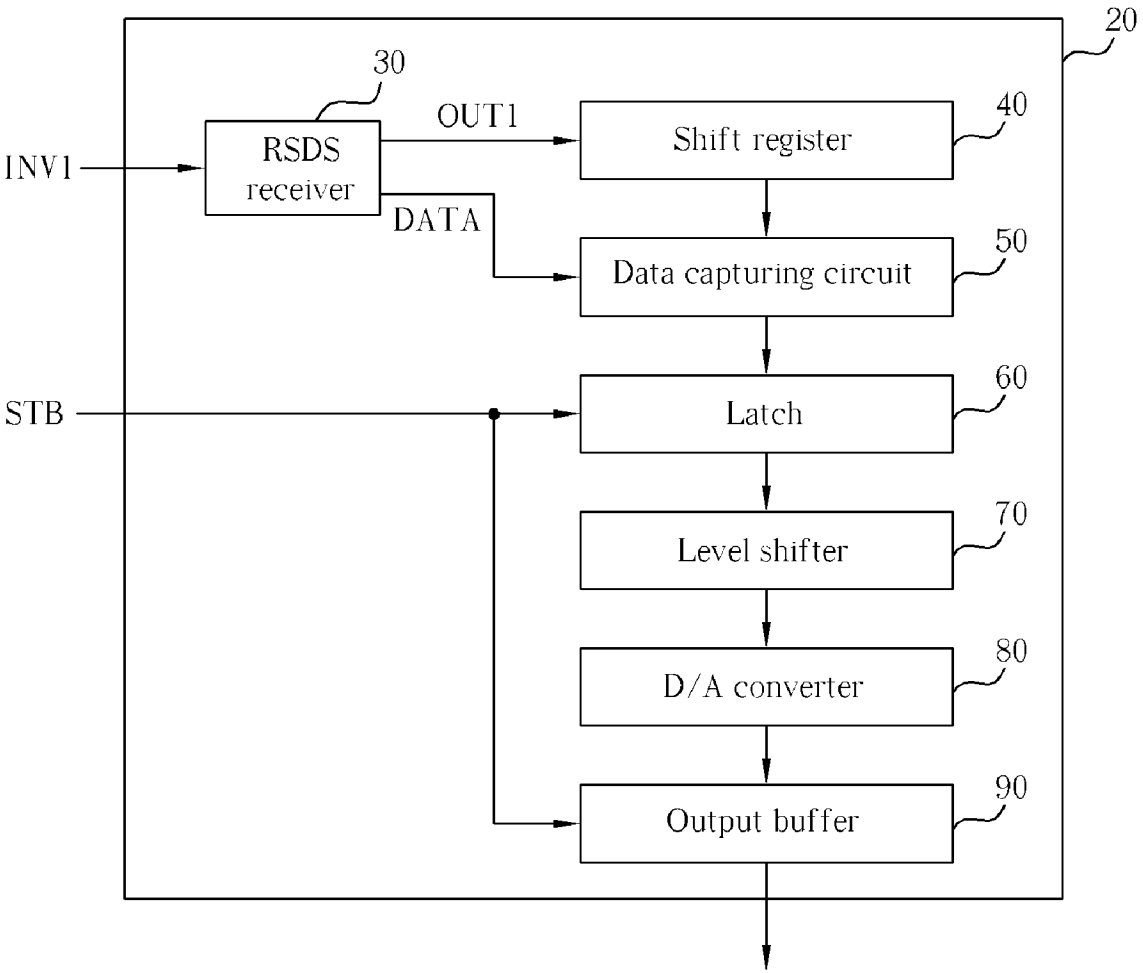
Fig. 2 Prior Art
FIG. 2 shows a diagram of a source driver in the liquid crystal display device in FIG. 1.
Figure 3:
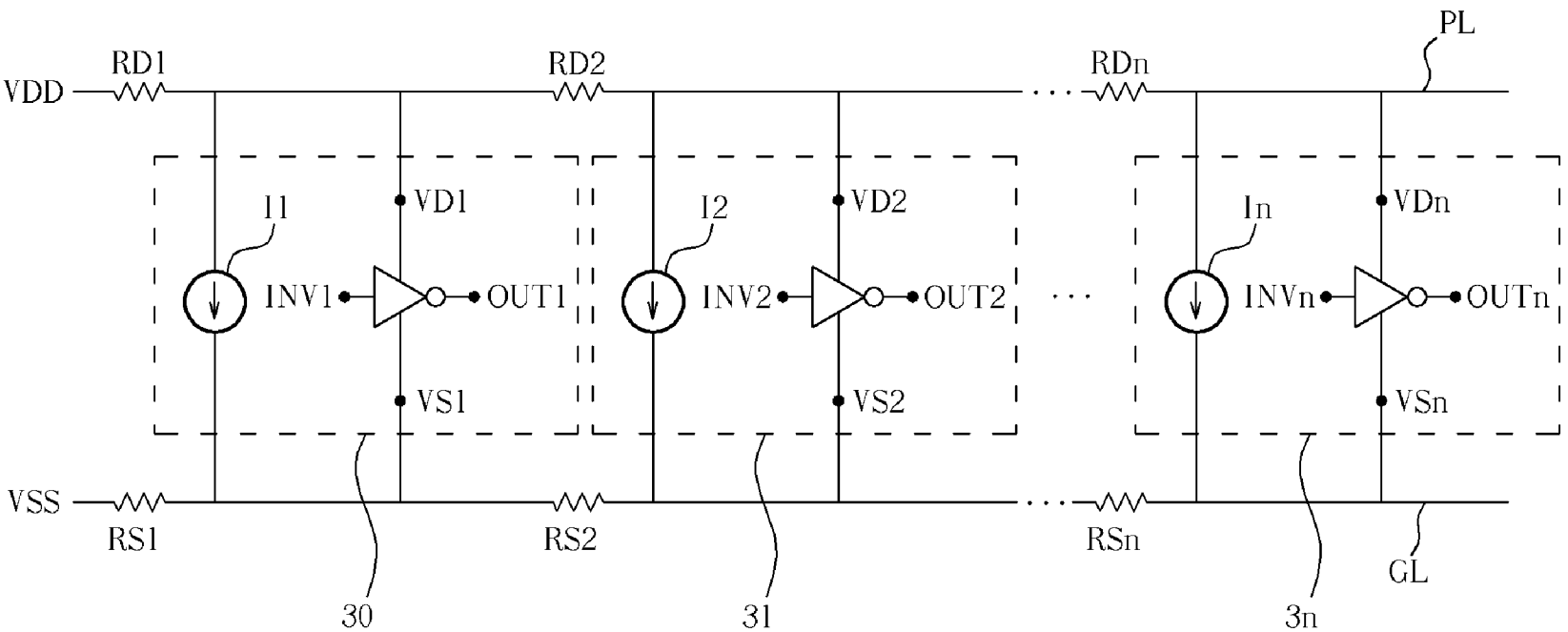
Fig. 3 Prior Art
FIG. 3 is a diagram showing an equivalent circuit of the RSDS receivers of the liquid crystal display device in FIG. 1.
Figure 4:
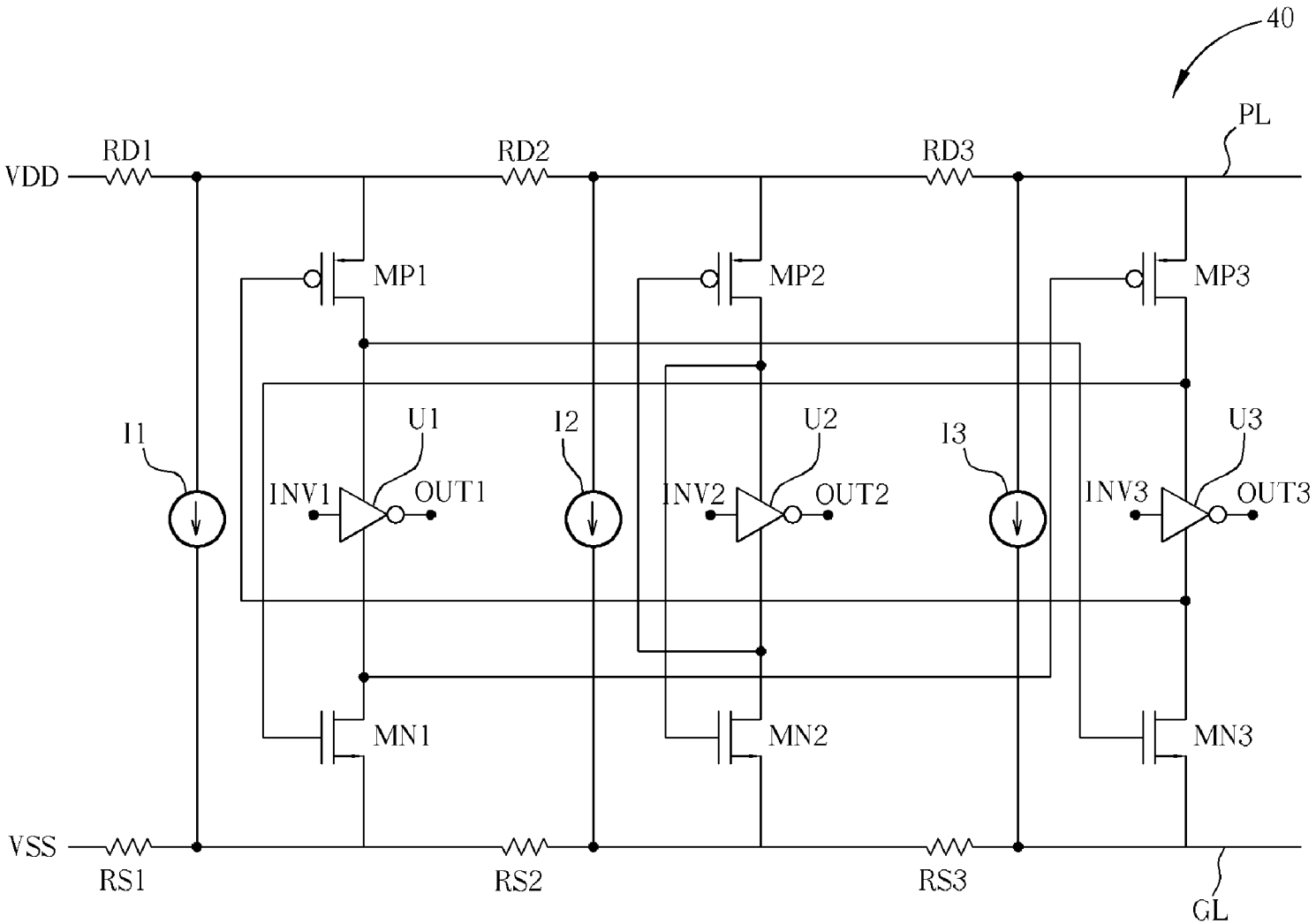
FIG. 4 is a diagram showing an RSDS receiver circuit according to a first embodiment of the present invention.

The present invention provides RSDS receiver circuits capable of synchronizing a plurality of outputs. FIG. 4 is a diagram showing an RSDS receiver circuit 40 according to a first embodiment of the present invention. The first embodiment of the present invention can provide odd output signals simultaneously. For ease of explanation, the RSDS receiver circuit 40 in FIG. 4 only provides three output signals OUT1-OUT3. The RSDS receiver circuit 40 includes power sources VDD and VSS, a power line PL, a ground line GL, inversion units U1-U3 (output buffers), P-type metal-oxide semiconductor (PMOS) transistors MP1-MP3, N-type metal-oxide semiconductor (NMOS) transistors MN1-MN3, and analog current sources I1-I3. The power sources VDD and VSS provide bias voltages to the inversion units U1-U3 via the power line PL and the ground line GL, respectively. RD1-RD3 are parasitic resistors of the power line PL, and RS1-RS3 are parasitic resistors of the ground line GL. Each of the analog current sources I1-I3 is coupled between the power line PL and the ground line GL.

The PMOS transistors MP1-MP3 provide current paths for charging the inversion units U1-U3, and the NMOS transistors MN1-MN3 provide current paths for discharging the inversion units U1-U3. Each of the PMOS transistors MP1-MP3 includes a source coupled to the power line PL and a drain coupled to a first bias end of a corresponding inversion unit. Each of the NMOS transistors MN1-MN3 includes a source coupled to the ground line GL and a drain coupled to a second bias end of a corresponding inversion unit. The gates of the PMOS transistors MP1-MP3 are coupled to the drains of the NMOS transistors MN3-MN1, respectively. The gates of the NMOS transistors MN1-MN3 are coupled to the drains of the PMOS transistors MP3-MP1, respectively.

Usually the inversion units U1-U3 are disposed in a way such that the parasitic resistors RD1-RD3 and RS1-RS3 have the same resistance. The voltage difference established across each parasitic resistor when the RSDS receiver circuit 40 is operating is represented by Δ. The source voltages Vs(MP1)-Vs(MP3) of the PMOS transistors MP1-MP3 and the source voltages Vs(MN1)-Vs(MN3) of the NMOS transistors MN1-MN3 can be represented by the following formulae:

$$Vs(MP1)=VDD-\Delta;$$

$$Vs(MP2)=VDD-2*\Delta;$$

$$Vs(MP3)=VDD-3*\Delta;$$

$$Vs(MN1)=VSS+\Delta;$$

$$Vs(MN2)=VSS+2*\Delta;$$

$$Vs(MN3)=VSS+3*\Delta;$$

When the PMOS transistors MP1-MP3 and the NMOS transistors MN1-MN3 are turned on, the drain-to-source voltages of the transistors are very small and can thus be regarded as zero. Therefore, the drain voltages Vd(MP1)-Vd(MP3) of the PMOS transistors MP1-MP3 and the drain voltages Vd(MN1)-Vd(MN3) of the NMOS transistors MN1-MN3 can be represented by the following formulae:

$$Vd(MP1)\approx Vs(MP1);$$

$$Vd(MP2)\approx Vs(MP2);$$

$$Vd(MP3)\approx Vs(MP3);$$

$$Vd(MN1)\approx Vs(MN1);$$

$$Vd(MN2)\approx Vs(MN2);$$

$$Vd(MN3)\approx Vs(MN3);$$

Since the gates of the PMOS transistors MP1-MP3 are coupled to the drains of the NMOS transistors MN3-MN1, respectively, the absolute values of the gate-to-source voltages Vgs(MP1)-Vgs(MP3) of the PMOS transistors MP1-MP3 can be represented by the following formulae:

$$|Vgs(MP1)|=|Vs(MN3)-Vs(MP1)|\approx VDD-VSS-4*\Delta;$$

$$|Vgs(MP2)|=|Vs(MN2)-Vs(MP2)|\approx VDD-VSS-4*\Delta;$$

$$|Vgs(MP3)|=|Vs(MN1)-Vs(MP3)|\approx VDD-VSS-4*\Delta;$$

Since the gates of the NMOS transistors MN1-MN3 are coupled to the drains of the PMOS transistors MP3-MP1, respectively, the gate-to-source voltages Vgs(MN1)-Vgs(MN3) of the NMOS transistors MN1-MN3 can be represented by the following formulae:

$$Vgs(MN1)=Vs(MP3)-Vs(MN1)\approx VDD-VSS-4*\Delta;$$

$$Vgs(MN2)=Vs(MP2)-Vs(MN2)\approx VDD-VSS-4*\Delta;$$

$$Vgs(MN3)=Vs(MP1)-Vs(MN3)\approx VDD-VSS-4*\Delta;$$

Since the absolute values of the gate-to-drain voltages of all transistors in the RSDS receiver circuit 40 are the same, the transistors can be turned on simultaneously. Therefore, the transistors provide the same driving ability for the inversion units U1-U3. By adjusting the sizes (W/L ratios), the NMOS and PMOS transistors can provide signals having the same rise and fall time, thereby synchronizing the output voltages OUT1-OUT3 for subsequent signal sampling.

Figure 5:
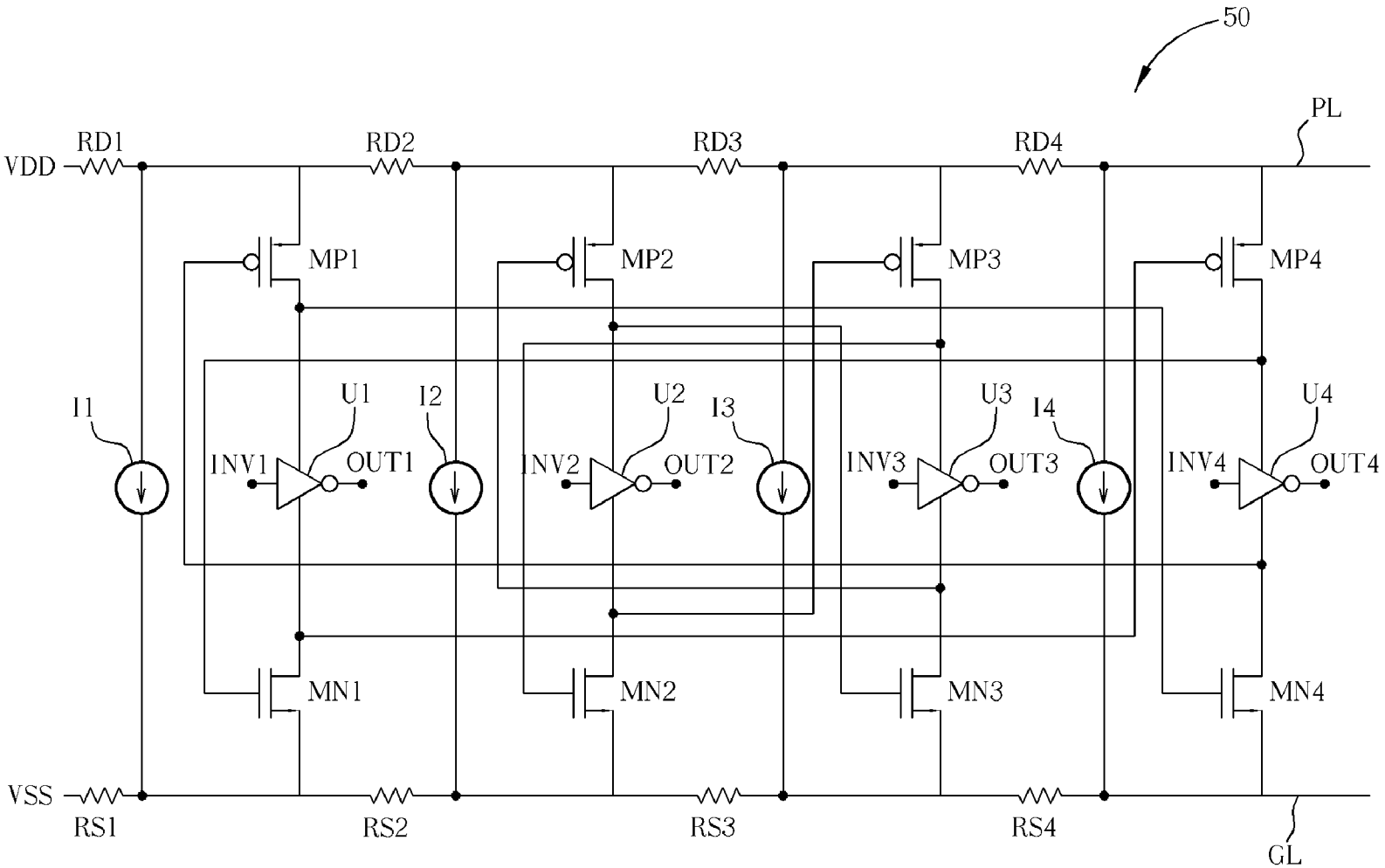
FIG. 5 is a diagram showing an RSDS receiver circuit according to a second embodiment of the present invention.

FIG. 5 is a diagram showing an RSDS receiver circuit 50 according to a second embodiment of the present invention. The second embodiment of the present invention can provide even output voltages simultaneously. For ease of explanation, the RSDS receiver circuit 50 in FIG. 5 only provides four output voltages OUT1-OUT4. The RSDS receiver circuit 50 includes power sources VDD and VSS, a power line PL, a ground line GL, inversion units U1-U4, PMOS transistors MP1-MP4, NMOS transistors MN1-MN4, and analog current sources I1-I4. The power sources VDD and VSS provide bias voltages to the inversion units U1-U4 via the power line PL and the ground line GL, respectively. RD1-RD4 are parasitic resistors of the power line PL, and RS1-RS4 are parasitic resistors of the ground line GL. Each of the analog current sources I1-I4 is coupled between the power line PL and the ground line GL.

The PMOS transistors MP1-MP4 provide current paths for charging the inversion units U1-U4, and the NMOS transistors MN1-MN4 provide current paths for discharging the inversion units U1-U4. Each of the PMOS transistors MP1-MP4 includes a source coupled to the power line PL and a drain coupled to a first bias end of a corresponding inversion unit. Each of the NMOS transistors MN1-MN4 includes a source coupled to the ground line GL and a drain coupled to a second bias end of a corresponding inversion unit. The gates of the PMOS transistors MP1-MP4 are coupled to the drains of the NMOS transistors MN4-MN1, respectively. The gates of the NMOS transistors MN1-MN4 are coupled to the drains of the PMOS transistors MP4-MP1, respectively.

Usually the inversion units U1-U4 are disposed in a way such that the parasitic resistors RD1-RD4 and RS1-RS4 have the same resistance. The voltage difference establish across each parasitic resistor when the RSDS receiver circuit 50 is operating is represented by Δ. The source voltages Vs(MP1)-Vs(MP4) of the PMOS transistors MP1-MP4 and the source voltages Vs(MN1)-Vs(MN4) of the NMOS transistors MN1-MN4 can be represented by the following formulae:

$$Vs(MP1)=VDD-\Delta;$$

$$Vs(MP2)=VDD-2*\Delta;$$

$$Vs(MP3)=VDD-3*\Delta;$$

$$Vs(MP4)=VDD-4*\Delta;$$

$$Vs(MN1)=VSS+\Delta;$$

$$Vs(MN2)=VSS+2*\Delta;$$

$$Vs(MN3)=VSS+3*\Delta;$$

$$Vs(MN4)=VSS+4*\Delta;$$

When the PMOS transistors MP1-MP4 and the NMOS transistors MN1-MN4 are turned on, the drain-to-source voltages of the transistors are very small and can thus be regarded as zero. Therefore, the drain voltages Vd(MP1)-Vd(MP4) of the PMOS transistors MP1-MP4 and the drain voltages Vd(MN1)-Vd(MN4) of the NMOS transistors MN1-MN4 can be represented by the following formulae:

$$Vd(MP1)\approx Vs(MP1);$$

$$Vd(MP2)\approx Vs(MP2);$$

$$Vd(MP3)\approx Vs(MP3);$$

$$Vd(MP4)\approx Vs(MP4);$$

$$Vd(MN1)\approx Vs(MN1);$$

$$Vd(MN2)\approx Vs(MN2);$$

$$Vd(MN3)\approx Vs(MN3);$$

$$Vd(MN4)\approx Vs(MN4);$$

Since the gates of the PMOS transistors MP1-MP4 are coupled to the drains of the NMOS transistors MN4-MN1, respectively, the absolute values of the gate-to-source voltages Vgs(MP1)-Vgs(MP4) of the PMOS transistors MP1-MP4 can be represented by the following formulae:

$$|Vgs(MP1)|=|Vs(MN4)-Vs(MP1)|\approx VDD-VSS-5*\Delta;$$

$$|Vgs(MP2)|=|Vs(MN3)-Vs(MP2)|\approx VDD-VSS-5*\Delta;$$

$$|Vgs(MP3)|=|Vs(MN2)-Vs(MP3)|\approx VDD-VSS-5*\Delta;$$

$$|Vgs(MP4)|=|Vs(MN1)-Vs(MP4)|\approx VDD-VSS-5*\Delta;$$

Since the gates of the NMOS transistors MN1-MN4 are coupled to the drains of the PMOS transistors MP4-MP1, respectively, the gate-to-source voltages Vgs(MN1)-Vgs(MN4) of the NMOS transistors MN1-MN4 can be represented by the following formulae:

$$Vgs(MN1)=Vs(MP4)-Vs(MN1)\approx VDD-VSS-5*\Delta;$$

$$Vgs(MN2)=Vs(MP3)-Vs(MN2)\approx VDD-VSS-5*\Delta;$$

$$Vgs(MN3)=Vs(MP2)-Vs(MN3)\approx VDD-VSS-5*\Delta;$$

$$Vgs(MN4)=Vs(MP1)-Vs(MN4)\approx VDD-VSS-5*\Delta;$$

Since the absolute values of the gate-to-source voltages of all transistors in the RSDS receiver circuit 50 are the same, the transistors can be turned on simultaneously. Therefore, the transistors provide the same driving ability for the inversion units U1-U4. By adjusting the sizes (W/L ratios), the NMOS and PMOS transistors can provide signals having the same rise and fall time, thereby synchronizing the output voltages OUT1-OUT4 for subsequent signal sampling.

Figure 6:
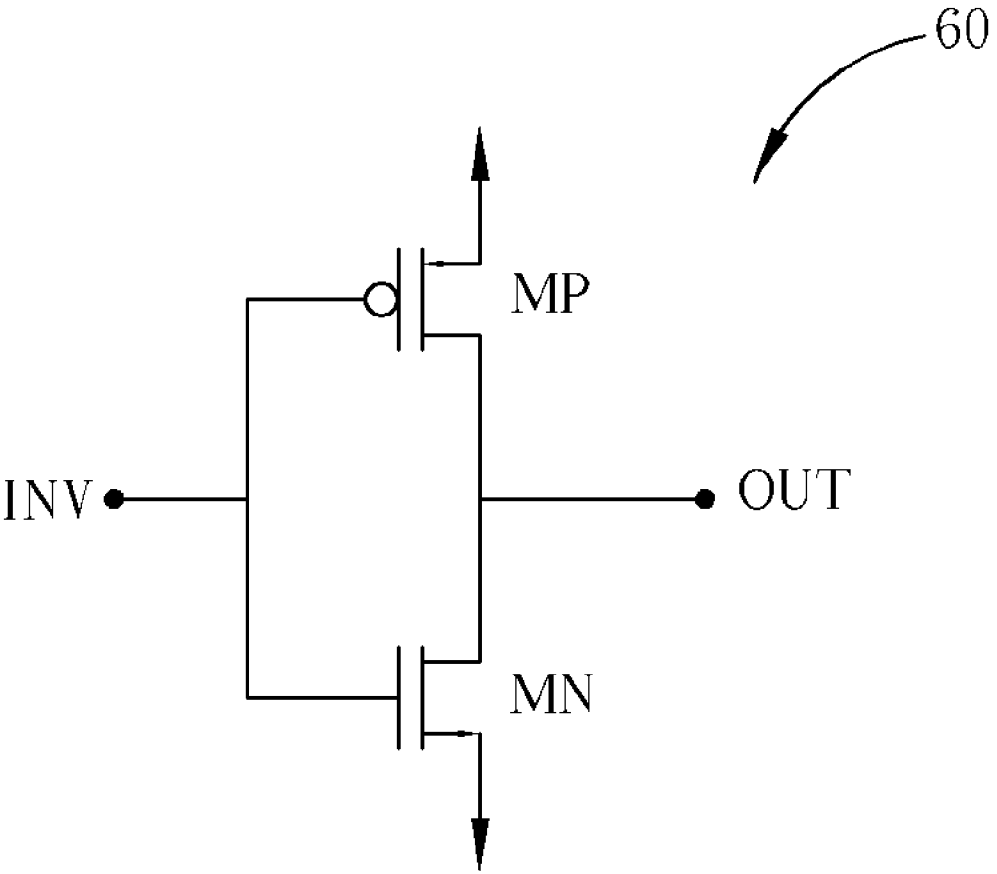
FIG. 6 is a diagram showing a CMOS inverter used for the RSDS receiver circuits in FIGS. 4 and 5.

The inversion units used in the RSDS receiver circuits 40 and 50 can include complimentary metal-oxide semiconductor (CMOS) inverters. FIG. 6 is a diagram showing a CMOS inverter 60 used for the inversion units of the RSDS receiver circuits 40 and 50. The CMOS inverter 60 includes a PMOS transistor MP and an NMOS transistor MN. The gate and the drain of the PMOS transistor MP are coupled to the gate and the drain of the NMOS transistor MN, respectively. When an input signal INV received at the gates of the transistors has a high level (logic 1), the NMOS transistor MN is turned on, and the PMOS transistor MP is turned off, thereby generating an output signal OUT having a low level (logic 0). When the input signal INV has a low level, the NMOS transistor MN is turned off, and the PMOS transistor MP is turned on, thereby generating an output signal OUT having a high level.

Figure 7:
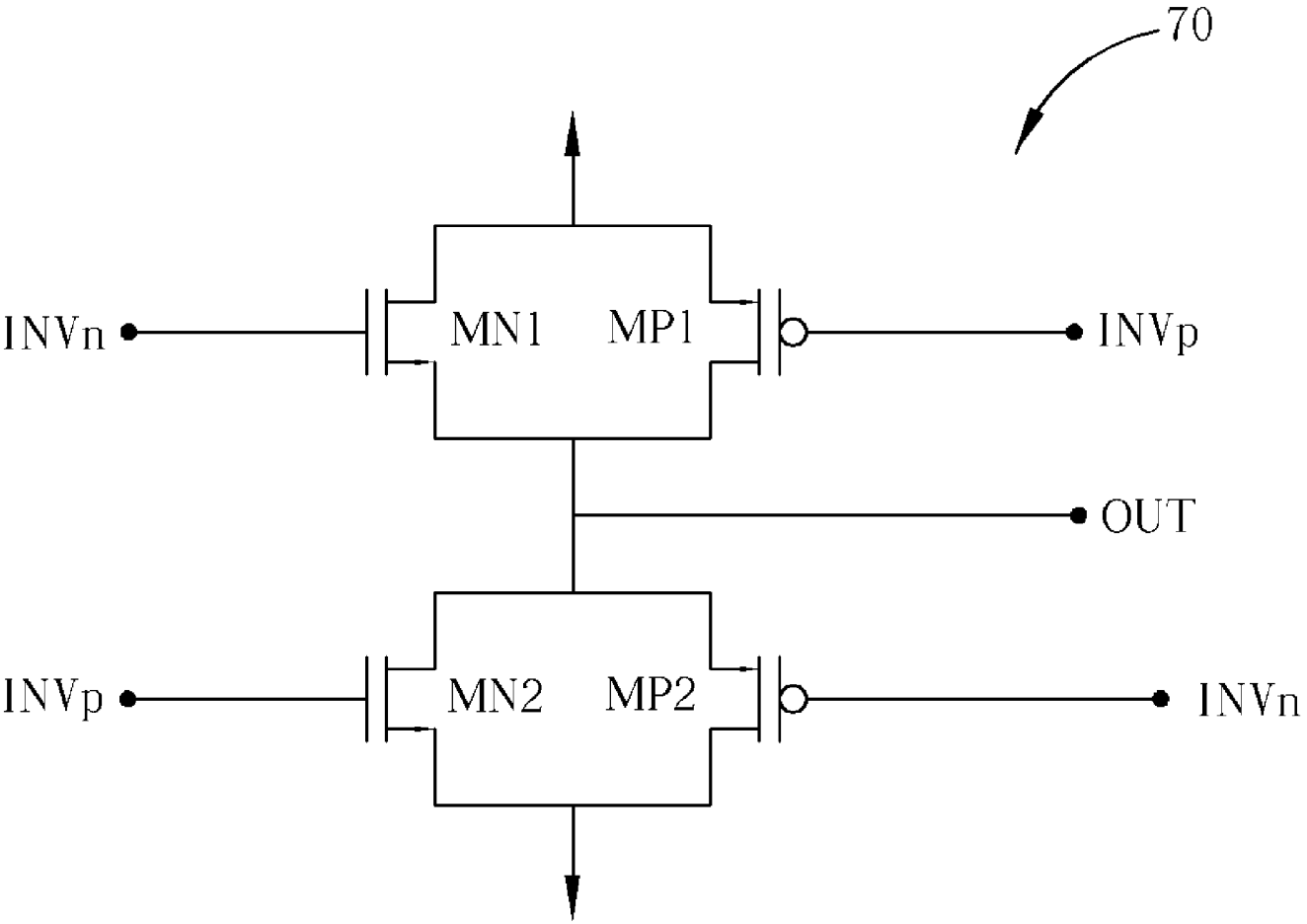
FIG. 7 is a diagram showing a CMOS inverter used for the RSDS receiver circuits in FIGS. 4 and 5.

FIG. 7 is a diagram showing another CMOS inverter 70 used for the inversion units of the RSDS receiver circuits 40 and 50. The CMOS inverter 70 includes PMOS transistors MP1-MP2 and NMOS transistors MN1-MN2. The gates of the PMOS transistors MP1 and MP2 are respectively coupled to $INV_P$ and $INV_N$, and the gates of the NMOS transistors MN1 and MN2 are respectively coupled to $INV_N$ and $INV_P$. The source of the NMOS transistor MN1, the drain of the NMOS transistor MN2, the drain of the PMOS transistor MP1, and the source of the PMOS transistor MP2 are coupled together. Input signals INVn and INVp are supplied to the gates of the transistors, and a corresponding output signal OUT is generated based on the levels of the input signals INVn and INVp. The inverters shown in FIGS. 6 and 7 are only two embodiments of the inversion units. Other types of inverters can also be adopted for the RSDS receivers of the present invention.

In the RSDS receivers of the present inventions, a plurality of PMOS transistors are provided for charging the inversion units, and a plurality of NMOS transistors are provided for discharging the inversion units. The gates of the transistors are coupled, as illustrated in FIGS. 4 and 5, so as to compensate different voltage drops caused by the parasitic resistors of the power lines. By adjusting the W/L ratio, the NMOS and PMOS transistors can generate signals having the same rise and fall time, thereby synchronizing multiple output signals for subsequent signal sampling.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A reduced swing differential signaling circuit for providing odd output voltages simultaneously, comprising:

a first PMOS transistor having a source coupled to a power line and a drain coupled to a first bias end of a first inversion unit;

a second PMOS transistor having a source coupled to the power line and a drain coupled to a first bias end of a second inversion unit;

a third PMOS transistor having a source coupled to the power line and a drain coupled to a first bias end of a third inversion unit;

a first NMOS transistor having a source coupled to a ground line, a drain coupled to a second bias end of the first inversion unit and to a gate of the third PMOS transistor, and a gate coupled to the drain of the third PMOS transistor;

a second NMOS transistor having a source coupled to the ground line, a drain coupled to a second bias end of the second inversion unit and to a gate of the second PMOS transistor, and a gate coupled to the drain of the second PMOS transistor; and a third NMOS transistor having a source coupled to the ground line, a drain coupled to a second bias end of the third inversion unit and to a gate of the first PMOS transistor, and a gate coupled to the drain of the first PMOS transistor;

wherein the first, second, and third inversion units provide the odd output voltages at corresponding output ends.

2. The reduced swing differential signaling circuit of claim 1 further comprising a current source coupled between the power line and the ground line.

3. The reduced swing differential signaling circuit of claim 1 further comprising a plurality of current sources each coupled between the power line and the ground line.

4. The reduced swing differential signaling circuit of claim 3 further comprising the power line having a parasitic resistor coupled in series between the source of the first PMOS transistor and the source of the second PMOS transistor.

5. The reduced swing differential signaling circuit of claim 4 further comprising the ground line having a parasitic resistor coupled in series between the source of the first NMOS transistor and the source of the second NMOS transistor.

6. A reduced swing differential signaling circuit for providing even output voltages simultaneously, comprising:

a first PMOS transistor having a source coupled to a power line and a drain coupled to a first bias end of a first inversion unit;

a second PMOS transistor having a source coupled to the power line and a drain coupled to a first bias end of a second inversion unit;

a third PMOS transistor having a source coupled to the power line and a drain coupled to a first bias end of a third inversion unit;

a fourth PMOS transistor having a source coupled to the power line and a drain coupled to a first bias end of a fourth inversion unit;

a first NMOS transistor having a source coupled to a ground line, a drain coupled to a second bias end of the first inversion unit and to a gate of the fourth PMOS transistor, and a gate coupled to the drain of the fourth PMOS transistor;

a second NMOS transistor having a source coupled to the ground line, a drain coupled to a second bias end of the second inversion unit and to a gate of the third PMOS transistor, and a gate coupled to the drain of the third PMOS transistor;

a third NMOS transistor having a source coupled to the ground line, a drain coupled to a second bias end of the third inversion unit and to a gate of the second PMOS transistor, and a gate coupled to the drain of the second PMOS transistor; and a fourth NMOS transistor having a source coupled to the ground line, a drain coupled to a second bias end of the third inversion unit and to a gate of the first PMOS transistor, and a gate coupled to the drain of the first PMOS transistor;

wherein the first, second, third, and fourth inversion units provide the even output voltages at corresponding output ends.

7. The reduced swing differential signaling circuit of claim 6 further comprising a plurality of current sources each coupled between the power line and the ground line.

8. The reduced swing differential signaling circuit of claim 6 further comprising the power line having a parasitic resistor coupled in series between the source of the first PMOS transistor and the source of the second PMOS transistor.

9. The reduced swing differential signaling circuit of claim 8 further comprising the ground line having a parasitic resistor coupled in series between the source of the first NMOS transistor and the source of the second NMOS transistor.

10. A reduced swing differential signaling circuit for providing odd output voltages simultaneously, comprising:

a first PMOS transistor having a source directly coupled to a power line and a drain directly coupled to a first bias end of a first inversion unit;

a second PMOS transistor having a source directly coupled to the power line and a drain directly coupled to a first bias end of a second inversion unit;

a third PMOS transistor having a source directly coupled to the power line and a drain directly coupled to a first bias end of a third inversion unit;

a first NMOS transistor having a source directly coupled to a ground line, a drain directly coupled to a second bias end of the first inversion unit and to a gate of the third PMOS transistor, and a gate directly coupled to the drain of the third PMOS transistor;

a second NMOS transistor having a source directly coupled to the ground line, a drain directly coupled to a second bias end of the second inversion unit and to a gate of the second PMOS transistor, and a gate directly coupled to the drain of the second PMOS transistor; and a third NMOS transistor having a source directly coupled to the ground line, a drain directly coupled to a second bias end of the third inversion unit and to a gate of the first PMOS transistor, and a gate directly coupled to the drain of the first PMOS transistor;

wherein the first, second, and third inversion units provide the odd output voltages at corresponding output ends.

* * * * *